US005678492A

United States Patent [19]

Pinkstone et al.

[11] Patent Number: 5,678,492

[45] Date of Patent: Oct. 21, 1997

[54] DISPLAY BOX WITH SHELVING FORMED FROM SINGLE PANEL

[75] Inventors: Felicia Pinkstone, Warrington, Pa.; Christian G. Keator, Milford, Conn.

[73] Assignee: KlearFold, Inc., Warrington, Pa.

[21] Appl. No.: 427,481

[22] Filed: Apr. 24, 1995

[51] Int. Cl.[6] ..... A47B 3/00

[52] U.S. Cl. ..... 108/165; 211/135

[58] Field of Search ..... 108/165, 162, 108/166, 167, 115; 211/72, 73, 135

[56] References Cited

U.S. PATENT DOCUMENTS

| | | | |
|---|---|---|---|
| 2,307,993 | 1/1943 | Calhoun et al. | 211/72 X |
| 2,312,594 | 3/1943 | Smith et al. | 211/72 |
| 3,115,376 | 12/1963 | Cupo | 211/73 X |
| 4,064,206 | 12/1977 | Seufert . | |
| 4,164,287 | 8/1979 | Muller et al. | 108/162 X |
| 4,179,252 | 12/1979 | Seufert . | |
| 4,348,449 | 9/1982 | Seufert . | |
| 4,477,013 | 10/1984 | Herrin . | |
| 4,618,115 | 10/1986 | Belokin, Jr. | 211/135 X |
| 4,664,648 | 5/1987 | Dupuy . | |
| 4,678,088 | 7/1987 | Flum | 211/73 |
| 5,213,220 | 5/1993 | McBride | 211/135 X |
| 5,315,936 | 5/1994 | Smith | 108/165 |
| 5,392,902 | 2/1995 | Vlastakis | 108/165 X |

FOREIGN PATENT DOCUMENTS

| | | | |
|---|---|---|---|
| 470689 | 1/1929 | Germany | 211/73 |
| 416189 | 9/1934 | United Kingdom | 211/137 |

*Primary Examiner*—Jose V. Chen

*Attorney, Agent, or Firm*—Panitch Schwarze Jacobs & Nadel, P.C.

[57] ABSTRACT

A multi-tier display rack is formed from a flat blank of sheet material. The sheet material includes four panels which create front, rear and opposed side walls of the display rack. In a preferred embodiment, one panel includes sections which are partially punched out to form shelves of the display rack. Each shelf includes a slot therethrough. Another panel includes locking tabs which are partially punched out and pushed through the slots to lock the shelves in place.

35 Claims, 5 Drawing Sheets

DISPLAY BOX WITH SHELVING FORMED FROM SINGLE PANEL

FIELD OF THE INVENTION

The present invention relates generally to displays and, more particularly, to a multi-tier display rack formed from a one-piece blank of sheet material.

BACKGROUND OF THE INVENTION

Display boxes formed from one-piece blanks are known in the art. One type of prior art display box is formed from a single thermoplastic sheet which folds into a generally elongated rectangular polygon having a top and a base, front and rear walls and opposed side walls. The top of the display box is open to allow the box to be filled with items or articles to be displayed. The front and side walls near the base are cut out to form an outlet to allow the articles on or near the base to be removed. As a portion of the articles are removed, gravity moves the remaining articles downward. The display box includes an opening in the rear wall for mounting or hanging the box. The display box is particularly suitable for dispensing pocket-sized packets of goods.

One disadvantage of the above-described prior art display box is that there is only a single outlet for the articles. Thus, such a box is generally suitable for displaying and dispensing only one type of article. Furthermore, such a box has no provision to neatly maintain the articles therein in a particular orientation. As one article is removed, the remaining articles merely fall into the freed up space in a random orientation. The result is that the remaining articles become jumbled in the display box, even if they were neatly arranged when originally placed in the display box.

There are other multi-tier prior art display boxes. However, such display boxes are generally of the injection molded type and, therefore, are expensive to produce in that they require costly tooling. In addition, such prior art display boxes are bulky in that they are always fully assembled and are, therefore, expensive to ship and store.

Accordingly, there is a need for a display box formed from a one-piece blank which can simultaneously display and dispense one or more articles or sets of articles without interfering with the display and dispensing of other articles or sets of articles, and which can maintain the articles or sets of articles in a neat, ordered manner and orientation within the display box. There is also a need for such a display box which is inexpensive to produce and which can be shipped and stored in a generally flat condition for quick and convenient assembly just prior to being used. The present invention fills that need by providing a one-piece blank which can be shipped and stored in a generally flattened condition and which can be quickly assembled to form a multi-tier display rack having shelves and a large open front for gaining access to the articles therein.

SUMMARY OF THE INVENTION

Briefly stated, the present invention in a first embodiment provides a multi-tier display rack formed from a flat blank of sheet material. The sheet material includes generally rectangular first, second, third and fourth panels. The first panel is divided into an alternating series of first and second generally rectangular sections having opposing side edge regions. Each of the first rectangular sections has an upper edge, a lower edge and opposed side edges. The first rectangular sections are pivotable from the first panel to create shelves of the display rack. Each of the first rectangular sections also includes a slot. The second panel extends from one of the opposing side edge regions of the first panel and forms a first side wall of the display rack. The third panel extends from the other of the opposing side edge regions of the first panel and forms a second side wall of the display rack opposite to the first side wall. The third panel also has opposing side edge regions, one side edge region extending from the first panel. The fourth panel extends from the other side edge region of the third panel for forming a rear wall of the display rack. The fourth panel includes a plurality of locking tabs defined thereon. The locking tabs are spaced along the panel and are generally aligned with respective slots in the first rectangular section. The locking tabs are pivotable from the fourth panel to mate with the slots during assembly of the display rack.

Another embodiment of the invention provides a multi-tier display rack formed from a generally flat blank of sheet material. Each tier of the display rack defines a compartment having a rear wall, opposed side walls, a front wall, and a base. The base has a front edge, rear edge and a slot. The front wall has an upper and lower edge. The front edge of the base of each compartment is integrally connected to the lower edge of the front wall of the compartment. The base is pivotable from the front edge to form the compartment base. The rear wall of each compartment includes a locking tab integrally connected thereto at one end. The locking tab is pivotable from the connected end for receipt by the slot of the base of a preselected compartment, thereby locking the base of the preselected compartment into position.

Yet another embodiment of the invention provides a generally rectangular polygonal form for use as a multi-tier shelving rack. The polygonal form is created from a single blank sheet of material. The polygonal form has a front wall, rear wall and opposed side walls. The front wall has a plurality of cut-out flaps attached at one edge to the front wall and pivotable into the interior space of the polygonal form to form shelves in the polygonal form. Each flap has a slot associated therewith. The rear wall has a plurality of locking tabs. Each locking tab is disposed opposite to a respective cut-out flap. The locking tabs are attached at one end to the rear wall and pivotable into the interior space of the polygonal form so as to be pushed through the slot of the respective cut-out flap and lock therein. In this manner, the locking tabs hold the cut-out flaps in place within the polygonal form.

Yet another embodiment of the invention provides a locking tab and mating slot combination. The combination assists in maintaining a shelf formed from sheet material in an outwardly extended position with respect to a rear wall. The combination comprises sheet material having a polygonal opening which acts as a slot, and a locking tab. The sheet material includes an upper and lower surface. The locking tab pivotally extends from a portion of the rear wall for pushing through one of the surfaces of the sheet material and resting on the other of the surfaces of the sheet material in a locked position.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF PREFERRED EMBODIMENTS

Certain terminology is used herein for convenience only and is not be taken as a limitation on the invention. Particularly, words such as "left," "right," "inward," "outward," "upper," "lower," "downward," "top," "bottom," "up," and "down" merely describe the configuration shown in the figures. Indeed, the one-piece blank or display rack formed therefrom may be oriented in any direction which allows the display rack to function as intended.

Figure 1A:
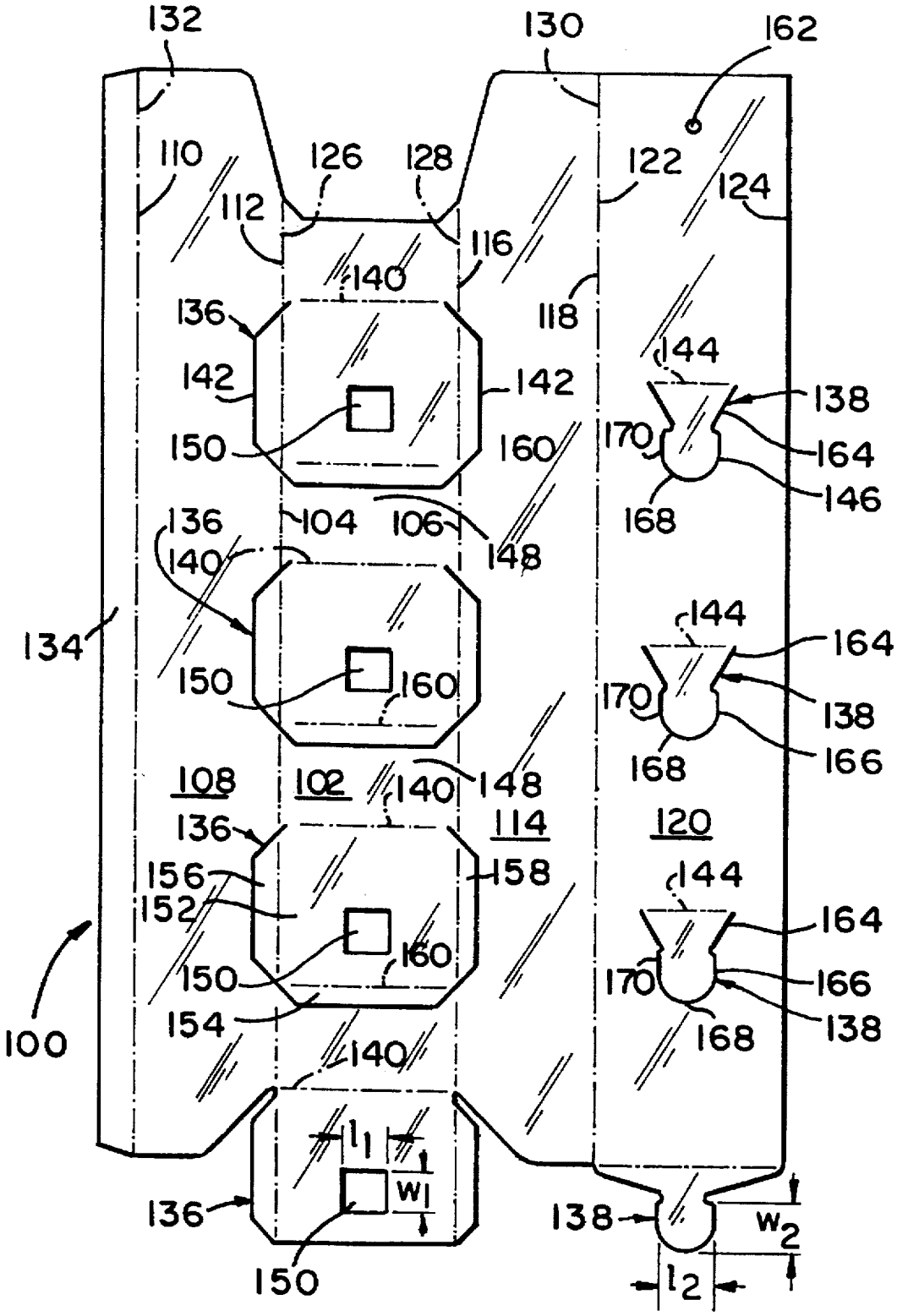
FIG. 1A is a top plan view of a preferred embodiment of a one-piece unassembled blank for forming a multi-tier display rack in accordance with the present invention.

Referring to the drawings, wherein the same reference numerals are employed for designating the same elements throughout the several figures, there is shown in FIG. 1A a preferred embodiment of a one-piece blank of sheet material 100 for forming a multi-tier display rack. The blank 100 is divided into a plurality of generally rectangular panels, each panel including opposing side edges (oriented as left and right side edges in FIG. 1A). Specifically, the blank includes a first rectangular panel 102 having left side edge 104 and right side edge 106; second rectangular panel 108 having left side edge 110 and right side edge 112 which abuts edge 104, third rectangular panel 114 having left side edge 116 which abuts edge 106 and right side edge 118; and fourth rectangular panel 120 having left side edge 122 which abuts edge 118 and right side edge 124. The second and third panels 108 and 114 flank the first panel 102. Thus, the second panel 108 extends from the left side edge 104 of the first panel 102, whereas the third panel 114 extends from the right side edge 106 of the first panel 102. The fourth panel 120 extends from the right side edge 118 of the third panel 114.

Figure 2:
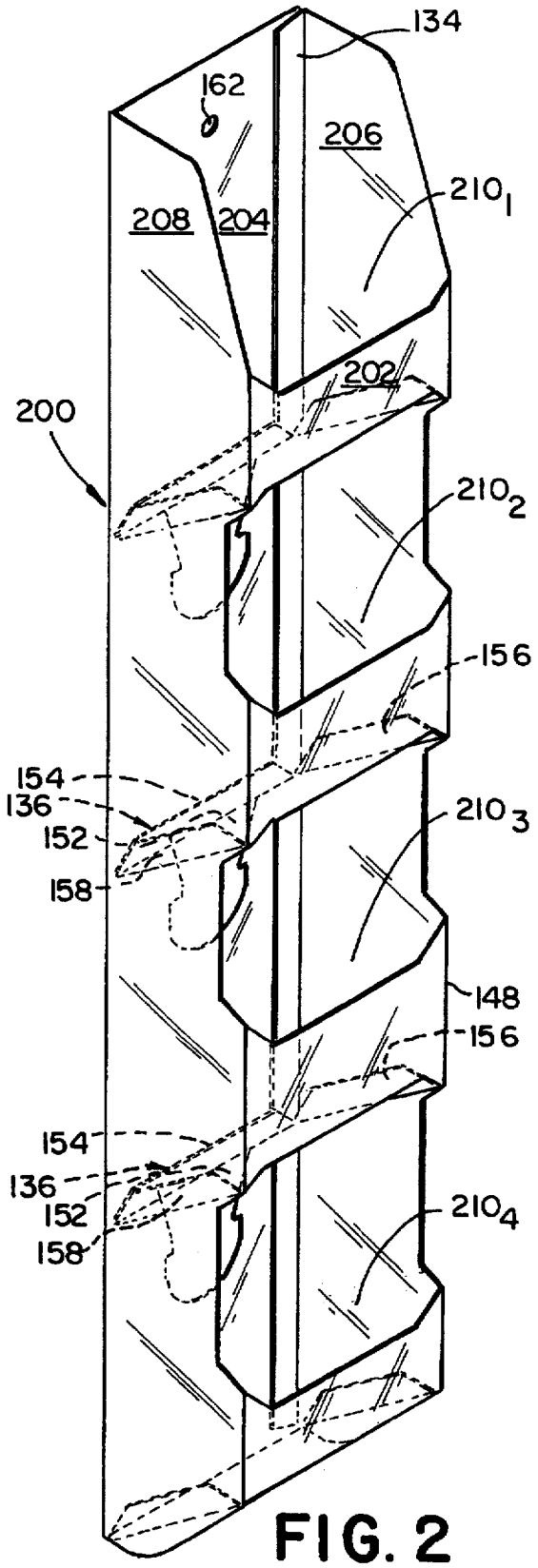
FIG. 2 is a perspective view of a fully assembled multi-tier display rack formed from the blank shown in FIG. 1A.
Figure 4:
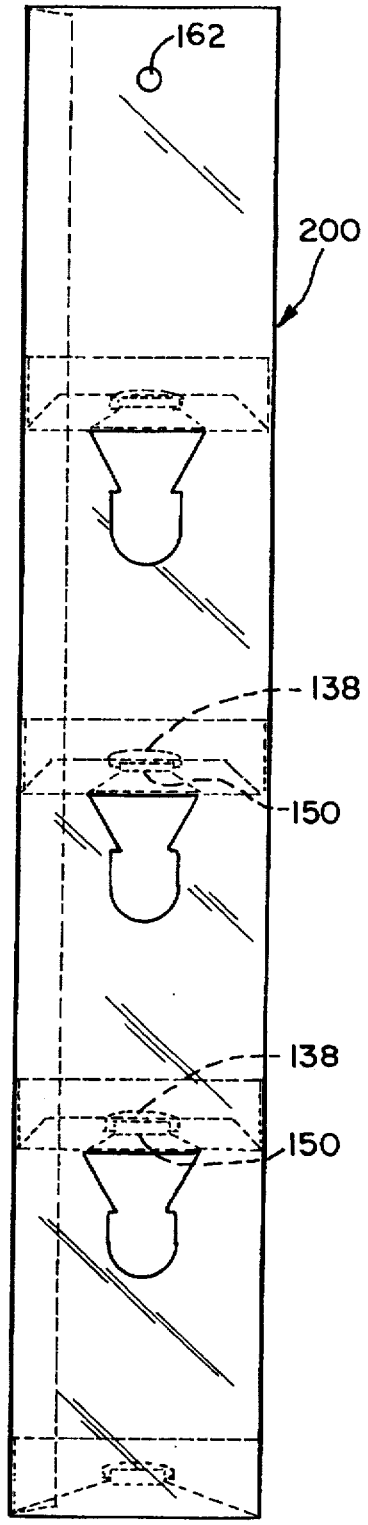
FIG. 4 is a rear elevation view of the multi-tier display rack of FIG. 2.

Flexible fold lines (shown as dotted-dashed lines in FIG. 1A) define the abutting side edges (104, 106, 110, 112, 116, 118, 122) of the panels 102, 108, 114 and 120. Thus, each pair of adjoining panels 102 and 108, 102 and 114, and 114 and 120 is separated by its respective flexible fold line. Since the blank 100 in FIG. 1A includes four panels, there are three such fold lines. Fold line 126 separates the first and second panels 102 and 108, fold line 128 separates the first and third panels 102 and 114, and fold line 130 separates the third and fourth panels 114 and 120. The second panel 108 includes a fourth flexible fold line 132 near the left side edge 110 which defines an attachment region 134. When the blank 100 is assembled into a display rack, the attachment region 134 is secured to a similar region near the right side edge 124 of the fourth panel 120, as best illustrated in FIGS. 2 and 4.

The blank 100 also includes cut lines (shown as thick solid lines in FIG. 1A) which define selected panel sections of the blank 100 which hinge or pivot inward or outward from a respective panel. The pivoting panel sections are an important feature of the invention, and are described in more detail below. There are two types of pivoting panel sections, generally rectangular panel sections (cut-out flaps) 136 associated generally with the first panel 102 and locking tabs 138 associated with the fourth panel 120. To facilitate pivoting of the rectangular panel sections 136, a flexible fold line 140 is made in the upper edge of each panel section 136 and a cut line 142 is made along the remaining peripheral edges of each panel section 136. To facilitate pivoting of the locking tabs 138, a flexible fold line 144 is made along the upper edge of each locking tab 138 and a cut line 146 is made along the remaining peripheral edges (i.e., the remaining perimeter) of each locking tab 138.

The first panel 102 is divided into an alternating series of generally rectangular panel sections 136 and generally rectangular spacer sections 148. Each panel section 136 has an opening 150 located near its center. The opening 150 functions as a slot for the locking tab 138. In the preferred embodiment of the invention, the opening 150 is square and located slightly below the center of the panel section 136. The opening 150 has a length $l_1$, width $w_1$ and area ($l_1 \times w_1$). Other opening shapes, such as non-square rectangles, and other opening locations near the center of panel section 136 are within the scope of the invention.

As noted above, the panel sections 136 are associated "generally" with the first panel 102. In the preferred embodiment of the invention shown in FIG. 1A, each panel section 136 includes small portions of the second and third panels 108 and 114, and thus each panel section 136 is not solely defined by an area of the first panel 102. More specifically, each panel section 136 is formed from (a) rectangular region 152 of the first panel 102; (b) a first flap tab 154 extending from the lower edge of the rectangular region 152 and disposed on the first panel 102; (c) a second flap tab 156 extending from the left edge of the rectangular region 152 and disposed on the second panel 108; and (d) a third flap tab 158 extending from the right edge of the rectangular region 152 and disposed on the third panel 114. Thus, the cut lines 142 associated with each panel section 136 actually define the outer edges of the flap tabs 154, 156 and 158. Flexible fold lines 160 separate the lower edge of the rectangular region 152 from the first flap tab 154. The left and right edges of the rectangular region 152 are separated from the corresponding second and third flap tabs 156 and 158 by portions of flexible fold lines 126 and 128, respectively.

In another embodiment of the invention shown in FIG. 1B and described in more detail below, there are no flexible flap tabs 156 and 158 instead, the fold lines 160 and portions of fold lines 126 and 128 on the lower left and right edges of the rectangular regions 152 are cut lines.

The fourth panel 120 includes a plurality of the arrow-shaped locking tabs 138 generally evenly spaced along a center region of the fourth panel 120. The arrow-shaped head or tip of each locking tab 138 faces downward. Each locking tab 138 is generally aligned with an opening 150 of a panel section 136. Thus, there is one locking tab 138 for each panel section 136. Each locking tab 138 is defined by a frustoconically shaped base portion 164 and a rounded, generally semicircular tip portion 166. More specifically, the tip 166 is defined by a rounded, generally semicircular tip portion 168 and flat portion 170 which is rearward of the tip portion 168 and disposed between the tip portion 168 and the base portion 164. The tip portion 166 has a length $l_2$, width $w_2$ and an area slightly less than ($l_2 \times w_2$), due to the rounding of the tip portion 166. The length $l_2$, width $w_2$ and area of the tip 166 is at least slightly greater than the length $l_1$, width $w_1$ and area, respectively, of the opening 150, best illustrated in FIG. 6 described below. The locking tab 138 need not have the particular shape shown in FIG. 1A. Other shapes are within the scope of the invention. For example, the locking tab 138 need not necessarily include the flat portion 170 or a semicircular shaped tip portion 168.

The upper region of the fourth panel 120 includes a small generally circular opening 162 for mounting or hanging an assembled display rack. The size, shape, location and number of openings 162 may vary in accordance with the manner in which the assembled display rack is mounted or hung.

FIG. 2 is a perspective view of a fully assembled multi-tier display rack 200 which may be quickly assembled (described below) without tools. The display rack 200 may be shipped and stored in a generally flat condition as shown in FIG. 1A until the display rack 200 is to be used. Alternatively, the display rack 200 may be partially assembled by securing together the attachment region 134 of the second panel to the right side edge 124 of the fourth panel 120 (as described below) prior to shipment and storage. To best understand how the blank 100 in FIG. 1A transforms into the display rack 200, FIGS. 1A and 2 are described together. To assemble the blank 100 of FIG. 1A into display rack 200 of FIG. 2, the four panels 102, 108, 114 and 120 are folded along the fold lines 126, 128 and 130 to create a generally rectangular polygonal form having a front wall 202, rear wall 204 and opposed side walls 206 and 208. The panel 102 becomes the front wall 202, the panel 120 becomes the rear wall 204 and the panels 108 and 114 become the opposed side walls 206 and 208, respectively. In FIG. 2, the front wall 202 includes only the rectangular spacer sections 148. However, before the display rack 200 is fully assembled, the front wall 202 includes both the spacer sections 148 and the rectangular regions 152 of the panel sections 136.

The attachment region 134 of the second panel 108 is glued, heat sealed or otherwise secured to a region near the right side edge 124 of the fourth panel 120 to maintain the rectangular polygonal form. At this stage of assembly, each of the plurality of locking tabs 138 (now associated with the rear wall 204) face a panel section 136 and its respective opening 150 (both now associated with the front wall 202). As discussed above, the assembly of the display rack 200, as thus far described, may be discontinued and the partially assembled display rack 200 may be conveniently shipped and/or stored in a generally flattened condition. Thereafter, when the display rack 200 is to be used, assembly may be completed as described below.

Next, the plurality of panel sections 136 are punched out so that they freely pivot about the respective fold lines 140 along their upper edges. The three flap tabs 154, 156 and 158 associated with each panel section 136 are folded inward with respect to the interior of the polygonal form. Each of the panel sections 136 are then pivoted into the interior space of the polygonal form to define the shelves of the display rack 200.

Figure 5:
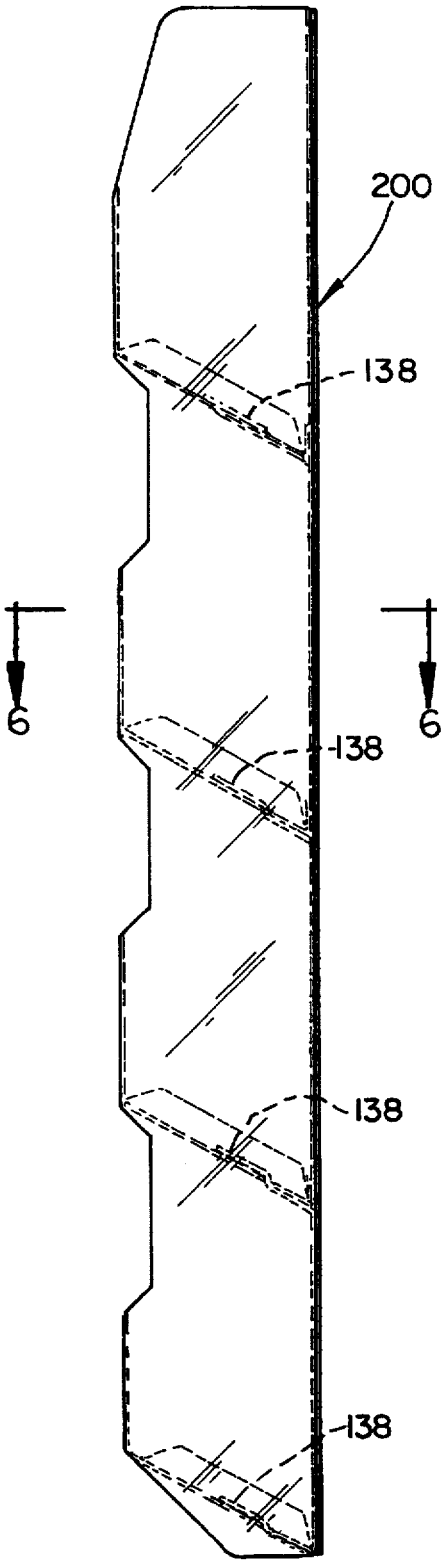
FIG. 5 is a side elevation view of the multi-tier display rack of FIG. 2.

In the preferred embodiment of the invention, the panel sections 136 and polygonal form are dimensioned so that the rectangular region 152 of each panel section 136 makes an acute angle with the rear wall 204, such as about 65 degrees (see FIG. 5). Thus, the shelves slope downward from the front wall 202 to the rear wall 204. However, in an alternative embodiment of the invention (not shown), the panel sections 136 and polygonal form are dimensioned so that the rectangular region 152 of each panel section 136 makes a right angle with the rear wall 204, thereby creating a generally flat level shelf. Alternatively, the blank 100 could be formed so that when assembled, the shelves slope upward from the front wall 202 (not shown). The precise orientation of the shelves (up slope, down slope, or level) will vary from application to application depending primarily upon the products or articles to be displayed and dispensed.

Figure 6:
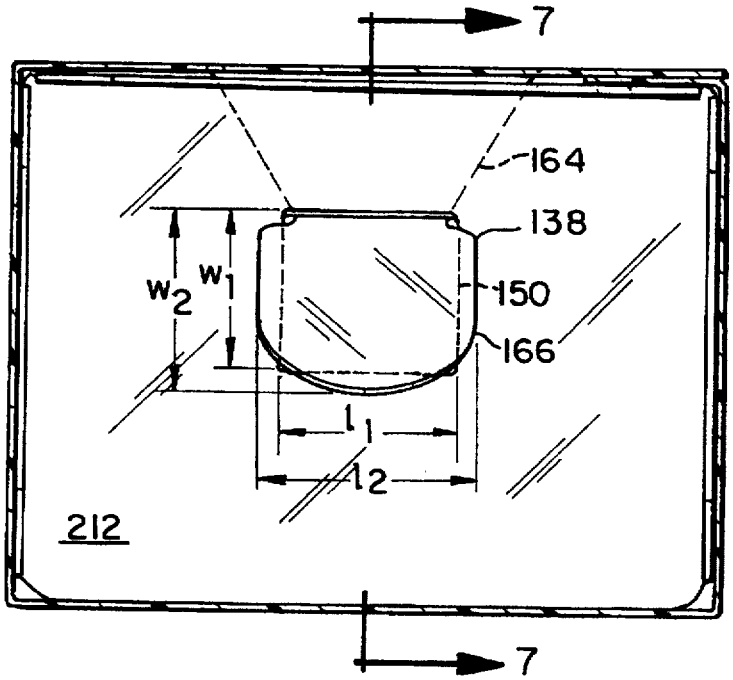
FIG. 6 is a sectional view of the floor of a compartment of the multi-tier display rack taken along line 6—6 of FIG. 5.

To lock each panel section 136 or shelf in place, the locking tab 138 facing a respective panel section 136 is punched out so that it pivots about the fold line 144 along its upper edge. The locking tab 138 is then pivoted into the interior space of the polygonal form. The tip 166 of the locking tab 138 is pushed through the opening 150 of the panel section 136 from the lower surface of the panel section 136 and is locked in place resting on the upper surface of the panel section 136. The tip 166 thus overlies the opening 150 and the portions of the panel section 136 surrounding the opening 150 as shown in FIG. 6. These steps are repeated with the remaining locking tabs 138 until every panel section 136 is locked in place by a respective locking tab 138. It should be understood that the blank 100 could be formed so that the locking tabs 138 are formed in the first panel 102 as part of the panel sections 136 which form the shelves and the openings 150 could be located in the fourth panel 120. With such an arrangement, assembly would be as generally described above except that the locking tabs 138 would be pushed out of the shelves and would be inserted into the openings 150 of the rear panel 102.

In the preferred embodiment of the invention, the bottom of the display rack 200 is formed from the bottommost panel section 136. To create such a display rack 200, the bottom of the first panel 102 ends in a panel section 136 (unflanked by second and third panels 108 and 114) and the bottom of the fourth panel 120 ends in a locking tab 138. To provide easy access to the topmost shelf of the display rack 200, a portion of the top of the first panel 102 is cut out.

After the display rack 200 is fully assembled (as shown in FIG. 2), it may be mounted to a wall or other support structure or hung from a nail or hook by the opening 162. Alternatively, the display rack 200 may be placed on the surface of a counter or other supporting surface (not shown). Each tier or compartment of the display rack 200 is then filled with articles or sets of articles or other contents to be displayed and dispensed. The display rack 200 includes four separate display compartments $\mathbf{210}_1$, $\mathbf{210}_2$, $\mathbf{210}_3$ and $\mathbf{210}_4$. Each compartment 210 is defined by a selected portion of the front, rear and side walls of the polygonal form. Of course, in a fully assembled rack, the front wall 202 is formed only by the spacer sections 148 of the first panel 102. The interior of each compartment 210 is accessed through the spaces left open in the front wall 202 and the forward portions of each of the side walls 206, 208 after each of the panel sections 136 are pivoted inward to create the shelves of the compartments.

The base or floor of each compartment 210 is thus constructed from the rectangular regions 152 of the panel sections 136 and from the locking tabs 138. (The panel sections 136 are shown in phantom in FIG. 2.) The flap tabs 154, 156 and 158 of the panel section 136 improve the structural integrity of the compartment floors by helping to brace the panel sections 136 against the rear wall 204 and opposed side walls 206 and 208. In the preferred embodiment, the flap tabs 154, 156 and 158 face up. However, the flap tabs 154, 156 and 158 may also face down.

Figure 1B:
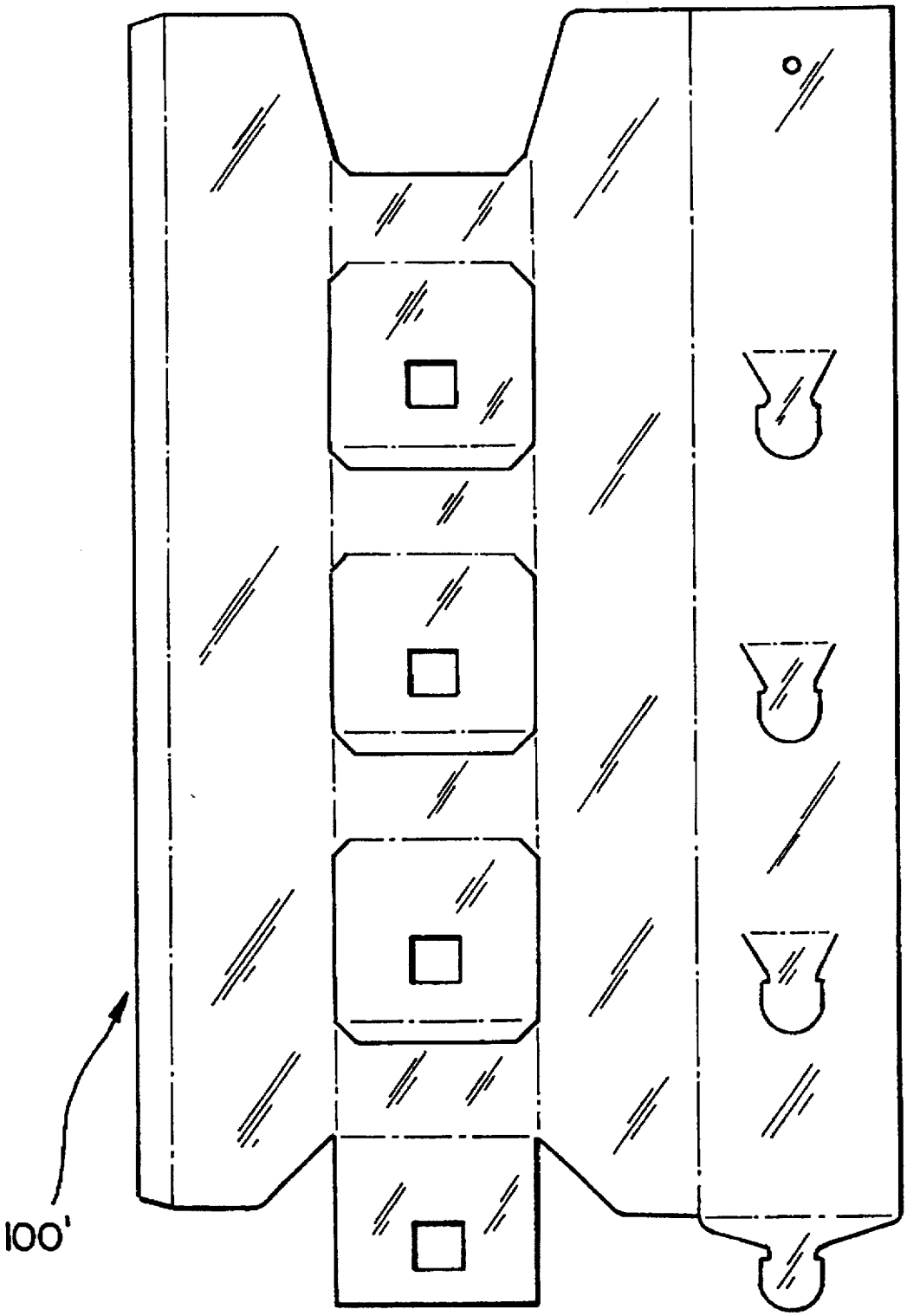
FIG. 1B is a top plan view of an alternative embodiment of a one-piece blank for forming a multi-tier display rack in accordance with the present invention.

FIG. 1B shows an alternative embodiment of a blank 100' which is identical to the blank 100, except that the blank 100' does not include the side flap tabs 156 and 158. These flap tabs may be omitted if the structural integrity of the compartment floor is not a major concern (e.g., if the articles in the display rack are expected to be light).

One important feature of the invention is that, in the present embodiment, the compartment floors slope downward from the front wall 202 to the rear wall 204. This feature allows the articles in the compartment to slide toward the rear wall 204. If a compartment 210 is filled with relatively wide, flat objects, such as multipacks of pens, the downwardly sloping floor allows the objects to remain upright and neatly organized, even as the number of articles in the compartment decreases. Furthermore, the articles remain neat and organized, even if an article is removed from the compartment out of order (e.g., from the rear of the compartment).

Figure 3:
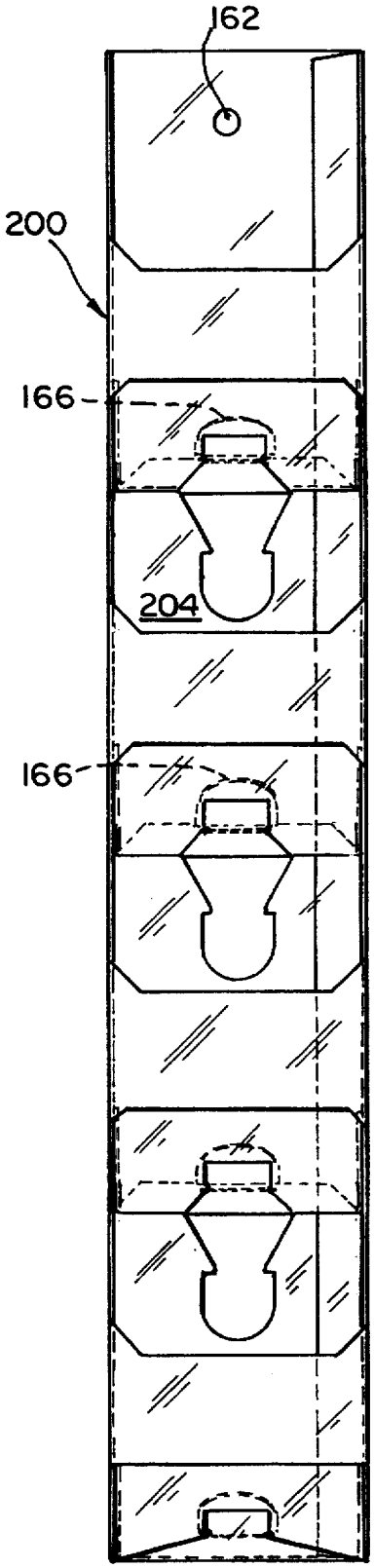
FIG. 3 is a front elevation view of the multi-tier display rack of FIG. 2.

FIG. 3 is a front elevation view of the fully assembled multi-tier display rack 200. This view shows the blank spaces left in the rear wall 204 after the locking tabs 138 are placed into position. The tips 166 of the locking tabs 138 are shown in phantom in FIG. 3.

FIG. 4 is a rear elevation view of the fully assembled multi-tier display rack 200. This view shows in phantom the base or floor of each compartment and the openings 150 and locking tabs 138 associated therewith.

Figure 7:
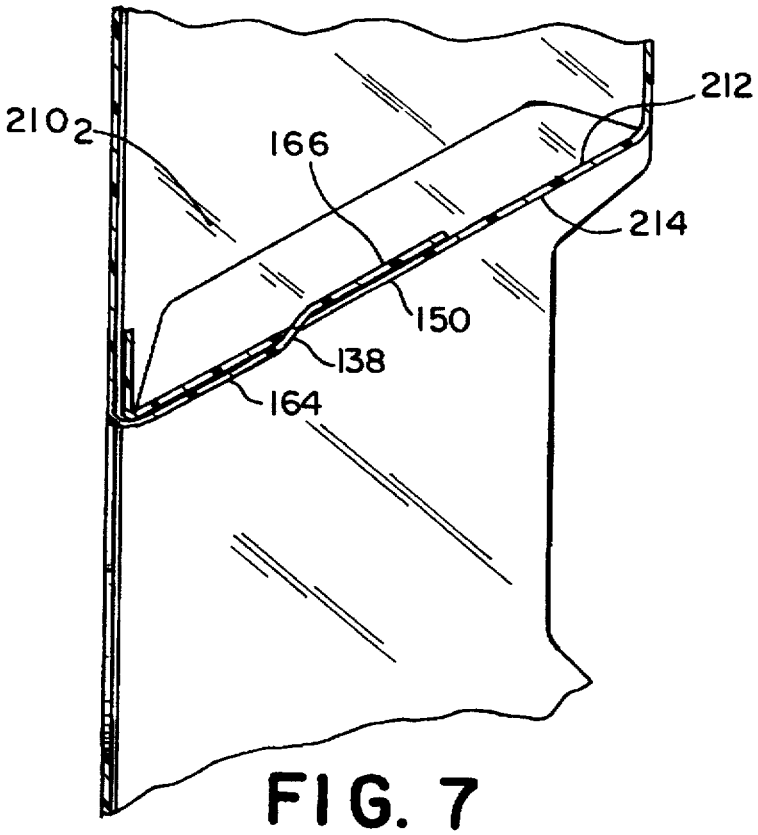
FIG. 7 is a sectional view of the floor associated with a compartment of the multi-tier display rack taken along line 7—7 of FIG. 6.

FIG. 5 is a side elevation view of the fully assembled multi-tier display rack 200. This view shows in phantom the base or floor of each compartment and the locking tabs 138 associated therewith. FIGS. 5, 6 and 7 best illustrate how the locking tabs 138 overlie at least a portion of the upper surface of each compartment floor.

FIG. 6 shows a sectional view of the floor of a compartment of the display rack 200 taken along line 6—6 of FIG. 5. FIG. 6 illustrates the interaction of the locking tab 138, the compartment floor and its slot or opening 150. Specifically, FIG. 6 shows upper floor surface 212 associated with the compartment $\mathbf{210}_2$ of FIG. 2. The base portion 164 of the locking tab 138 is shown in phantom because it is disposed under the lower floor surface. The tip 166 of the locking tab 138 overlie the entire area of the opening 150 and small areas of the upper floor surface 212 adjacent to the opening 150.

The locking tab arrangement is another important feature of the invention. This arrangement creates a sturdy compartment floor which resists significant downward force. Each of the locking tabs 138 in this invention lock a compartment floor into position, while simultaneously replacing part of the floor which is missing due to the opening 150. The locking tab arrangement is also very easy to assemble. Typically, locking tabs are fitted through narrow, slit-like slots. In the present invention, the slot is a wide rectangular opening which easily receives the locking tab.

FIG. 7 is a sectional view of the floor associated with the compartment $\mathbf{210}_2$ taken along line 7—7 of FIG. 6. FIG. 7 shows the upper floor surface 212 and lower floor surface 214. The base portion 164 of the locking tab 138 is flush against the lower floor surface 214, whereas the tip 166 of the locking tab 138 overlies the opening 150 and portions of the upper floor surface 212.

In an alternative embodiment of the invention (not shown), the tip 166 of the locking tab 138 is pushed through the opening 150 from the upper floor surface 212 and locks in place facing the lower floor surface 214. In this reversed version of the preferred embodiment, the locking tab 138 is punched out and pivoted into the interior space of the polygonal form before the respective panel section 136 is pivoted into the interior space. The floors formed by this alternative technique do not possess the structural integrity of the preferred embodiment. However, this alternative embodiment be useful if it is desired to dispose the tip 166 of the locking tab 138 below the floor of each compartment.

It should be understood that the widths of the four sheet panels in FIG. 1A will depend on the desired interior dimensions of the shelving units of the assembled display rack 200. Also, the number of panel sections 136 and locking tabs 138 will depend upon the desired number of shelves or compartments in the assembled display rack 200.

In the preferred embodiment of the invention, the blank 100 is a clear or translucent thermoplastic sheet which thus forms a see-through or semi-see-through display rack 200. Alternatively, the thermoplastic sheet may be opaque. Thermoplastic materials which are particularly suitable for the blank 100 include polyvinyl chloride (PVC), polypropylene, polyethylene and other thermoplastic polyesters (PETs). Furthermore, other types of sheet material such as cardboard, paperboard or the like, may be employed instead of thermoplastic.

Apparatus and methods for creating flexible fold lines and cut lines in thermoplastic sheets are known in the art, and thus are not described in further detail. Examples of such apparatus and methods are found in U.S. Pat. Nos. 4,064,206, 4,179,252 and 4,348,449, all issued to Seufert.

From the foregoing, it can be seen that the present invention comprises a one-piece blank 100 which quickly and easily creates a multi-tier display rack 200. The display rack 200 has sturdy shelves which are locked in place by a novel locking tab/slot combination. The shelves may slope downward or upward or may be level to help maintain contents in an ideal display position. The contents of the display rack are easily accessed from a large open space in the front region of each compartment 210. The display rack 200 may be shipped and/or stored in a generally flattened condition to save space and may be quickly assembled without tools when needed for display of articles. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A multi-tier display rack formed from a flat blank of sheet material, the sheet material comprising:

(a) a generally rectangular first panel divided into an alternating series of first and second generally rectangular sections and having opposing side edge regions, each of the first rectangular sections having an upper edge, a lower edge and opposed side edges, the first rectangular sections being pivotable from the first panel to create shelves of the display rack, the first rectangular sections forming substantially the entire shelf of each tier, each of the first rectangular sections also including a slot;

(b) a generally rectangular second panel extending from one of the opposing side edge regions of the first panel for forming a first side wall of the display rack;

(c) a generally rectangular third panel extending from the other of the opposing side edge regions of the first panel for forming a second side wall of the display rack opposite to the first side wall, the third panel also having opposing side edge regions, one side edge region extending from the first panel; and (d) a generally rectangular fourth panel extending from the other side edge region of the third panel for forming a rear wall of the display rack, the fourth panel including a plurality of locking tabs defined thereon, each of the locking tabs being attached at one end to the fourth panel, the locking tabs being spaced along the panel and generally aligned with respective slots in the first rectangular section, the locking tabs being pivotable from the fourth panel at the attached end to mate with the respective slots during assembly of the display rack.

2. A multi-tier display rack according to claim 1 wherein each of the first rectangular sections include a fold line along the upper edge and a cut line near the lower edge, and the sheet material includes cut lines near the side edges of the first rectangular sections, the fold line and cut lines allowing the first rectangular sections to pivot from the first panel.

3. A multi-tier display rack according to claim 2 wherein the lower edge and opposed side edges of each of the first rectangular sections include fold lines, the cut lines in the sheet material being in the second panel, said fold lines creating flap tabs for the first rectangular sections.

4. A multi-tier display rack according to claim 1 wherein the first, second, third and fourth panels are formed from a one-piece blank.

5. A multi-tier display rack according to claim 4 wherein the one-piece blank is a thermoplastic material.

6. A multi-tier display rack according to claim 5 wherein the thermoplastic material is clear or translucent.

7. A multi-tier display rack according to claim 1 wherein each of the locking tabs include a fold line along the upper edge, and cut lines along the remaining perimeter of the locking tabs, the fold line and cut lines allowing the locking tabs to pivot from the fourth panel.

8. A multi-tier display rack according to claim 1 wherein the second panel also has opposing side edge regions, one side edge region extending from the first panel, and the fourth panel also has opposing side edge regions, one side edge region extending from the third panel, the other side edge region of the second panel overlying the other side edge region of the fourth panel and allowing attachment thereto during assembly of the display rack.

9. A multi-tier display rack according to claim 1 wherein the slot is near the center of the first rectangular section.

10. A multi-tier display rack according to claim 1 further comprising flexible fold lines at adjacent side edge regions of the first, second and third panels for forming corners of the display rack.

11. A multi-tier display rack comprising:

(a) a generally rectangular first panel divided into an alternating series of first and second generally rectangular sections and having opposing side edge regions, each of the first rectangular sections having an upper edge, a lower edge and opposed side edges, and including a fold line along the upper edge and cut lines along the side edges and lower edge, the fold line and cut lines allowing the rectangular section to pivot from the first panel to create shelves of the display rack, the first rectangular sections forming substantially the entire shelf of each tier, each of the first rectangular sections also including a slot;

(b) a generally rectangular second panel extending from one of the opposing side edge regions of the first panel for forming a first side wall of the display rack;

(c) a generally rectangular third panel extending from the other of the opposing side edge regions of the first panel for forming a second side wall of the display rack opposite to the first side wall, the third panel also having opposing side edge regions, one side edge region extending from the first panel; and (d) a generally rectangular fourth panel extending from the other side edge region of the third panel for forming a rear wall of the display rack, the fourth panel including a plurality of locking tabs defined thereon, each of the locking tabs being attached at one end to the fourth panel, the locking tabs being spaced along the panel and generally aligned with respective slots in the first rectangular section, the locking tabs being pivotable from the fourth panel at the attached end to mate with the respective slots during assembly of the display rack.

12. A multi-tier display rack formed from a generally flat blank of sheet material, each tier of the display rack defining a compartment having a rear wall, opposed side walls, a front wall, and a base, the base having a front edge, rear edge and a slot, the front wall having an upper and lower edge, the front edge of the base of each compartment being integrally connected to the lower edge of the front wall of the compartment, the base being pivotable from the front edge to form substantially the entire compartment base, the rear wall of each compartment including a locking tab integrally connected thereto at one end, the locking tab being pivotable from the connected end for receipt by the slot of the base of a preselected compartment, thereby locking the base of the preselected compartment into position.

13. A multi-tier display rack according to claim 12 wherein the preselected compartment is the compartment above the compartment associated with locking tab, thereby permitting each locking tab to lock the base of the compartment above into position.

14. A display rack according to claim 12 wherein the sheet material is thermoplastic.

15. A display rack according to claim 14 wherein the thermoplastic material is clear or translucent.

16. A display rack according to claim 12 wherein the compartment is defined by an upper portion and a lower portion, and the upper edge of the front wall of each compartment extends across only the lower portion of the compartment, thereby allowing access to any contents therein from the upper portion of the compartment.

17. A display rack according to claim 12 wherein the base of each compartment slopes downward from the front wall to the rear wall, thereby allowing any contents therein to slide toward the rear wall.

18. A display rack according to claim 12 wherein the display rack forms a unitary structure with vertically oriented tiers, the display rack further comprising an opening in the rear wall of a topmost compartment for allowing the display rack to hang in the vertical orientation when a fastener is placed through the opening and fixed to a solid object.

19. A display rack according to claim 12 wherein each slot is near the center of the corresponding base.

20. A display rack according to claim 12 wherein each slot is generally rectangular and the area of the corresponding locking tab is greater than the area of the slot, thereby causing the locking tab to overlie the slot after the locking tab is inserted through the slot.

21. A generally rectangular polygonal form for use as a multi-tier shelving rack, the polygonal form created from a single blank sheet of material, the polygonal form having a front wall, rear wall and opposed side walls, the front wall having a plurality of cut-out flaps attached at one edge to the front wall and pivotable into the interior space of the polygonal form to form shelves in the polygonal form, each flap forming substantially the entire shelf for the respective tier, each flap having a slot associated therewith, the rear wall having a plurality of locking tabs, each locking tab disposed opposite to a respective cut-out flap, the locking tabs being attached at one end to the rear wall and pivotable into the interior space of the polygonal form from the rear wall so as to be pushed through the slot of the respective cut-out flap and lock therein, thereby holding the cut-out flaps in place within the polygonal form.

22. A polygonal form according to claim 21 wherein the plurality of cut-out flaps are formed from a portion of the front wall and a portion of each opposed side wall, each cut-out flap including three free edge regions and a flap tab adjacent each free edge region, one flap tab being formed from a portion of the front wall, and two flap tabs being formed from a portion of each of the opposed side walls, the flap tabs folding inward with respect to the interior of the polygonal form and bracing the cut-out flap against the opposed side walls and the rear wall after the cut-out flap is pivoted into the interior space of the polygonal form and locked in place.

23. A polygonal form according to claim 21 wherein the plurality of cut-out flaps are separated by spaced portions of the front wall before the flaps are pivoted into the interior space of the polygonal form, the spaced portions forming the front wall of a fully assembled multi-tier shelving rack.

24. A locking tab and mating slot combination for assisting in maintaining a shelf formed from sheet material in an outwardly extended position with respect to a rear wall, the combination comprising:

(a) sheet material having a polygonal opening which acts as a slot, the sheet material including an upper and lower surface, the sheet material forming substantially the entire shelf; and (b) a locking tab attached at one end to a portion of the rear wall and pivotally extending from the rear wall for pushing through one of the surfaces of the sheet material and resting on the other of the surfaces of the sheet material in a locked position.

25. A combination according to claim 24 wherein the locking tab is arrow-shaped.

26. A combination according to claim 25 wherein only the tip of the arrow extends through the slot.

27. A combination according to claim 26 wherein the slot is generally rectangular and the area of the tip of arrow is greater than the area of the slot, thereby causing the tip of the arrow to completely overlie the slot after the tip extends through the slot.

28. A combination according to claim 25 wherein the tip of the arrow is rounded.

29. A combination according to claim 25 wherein the tip of the arrow is generally semicircular.

30. A combination according to claim 24 wherein the locking tab extends from a portion of the rear wall below the sheet material, the locking tab pushing through the lower surface of the sheet material and resting on the upper surface of the sheet material in the locked position.

31. A combination according to claim 24 wherein the slot is near the center of the sheet material.

32. A combination according to claim 24 wherein the area of the locking tab is greater than the area of the slot, thereby causing the locking tab to completely overlie the slot after the locking tab is inserted through the slot.

33. A combination according to claim 24 wherein the slot is generally rectangular.

34. A combination according to claim 24 wherein the locking tab is arrow shaped and includes a frustoconically shaped base portion and an adjacent generally semicircular tip.

35. A combination according to claim 34 wherein the tip includes a generally semicircular tip portion and a flat portion rearward of the tip portion and disposed between the tip portion and the base portion.

* * * * *